United States Patent [19]

Fukuroi

[11] Patent Number: 4,607,415

[45] Date of Patent: Aug. 26, 1986

[54] BUTTON FOR GARMENT

[75] Inventor: Takeo Fukuroi, Uozu, Japan

[73] Assignee: Nippon Notion Kogyo Co., Ltd., Tokyo, Japan

[21] Appl. No.: 671,938

[22] Filed: Nov. 15, 1984

[30] Foreign Application Priority Data

Nov. 16, 1983 [JP] Japan ..... 58-176967[U]

[51] Int. Cl.[4] ..... A44B 1/42

[52] U.S. Cl. ..... 24/94; 24/92; 24/95; 24/113 R

[58] Field of Search ..... 24/94, 95, 92, 113 R, 24/113 MP, 621, 622, 681, 691

[56] References Cited

U.S. PATENT DOCUMENTS

| | | | |
|---|---|---|---|
| 377,768 | 2/1888 | Noyes | 24/95 |
| 439,920 | 11/1890 | Williams et al. | 24/95 |
| 446,139 | 2/1891 | Richardson | 24/691 |
| 553,210 | 1/1896 | Mead | 24/95 |
| 621,541 | 3/1899 | Richardson | 24/94 |
| 663,521 | 12/1900 | Shipman et al. | 24/95 |
| 1,373,076 | 3/1921 | Jaquiery | 24/621 |
| 1,646,053 | 10/1927 | Clark | 24/95 |
| 2,640,243 | 6/1953 | Jones | 24/691 |
| 3,316,793 | 5/1967 | Mitchell | 24/94 |
| 4,512,063 | 4/1985 | Fukuroi | 24/94° |

FOREIGN PATENT DOCUMENTS

| | | | |
|---|---|---|---|
| 642929 | 9/1928 | France | 24/691 |
| 1021783 | 2/1953 | France | 24/95 |
| 44-5791 | 3/1969 | Japan . | |

*Primary Examiner*—Victor N. Sakran

*Attorney, Agent, or Firm*—Hill, Van Santen, Steadman & Simpson

[57] ABSTRACT

A button for attachment to a garment fabric comprises a capped button body and a tack member adapted to be joined with the button body, wherein a shank of said tack member includes a free end portion being deformable into a radially uniformly and axially compressed configuration, a radially cold-pressed recessed portion disposed adjacent to said end portion, and a deformation-free stem portion.

24 Claims, 12 Drawing Figures

BUTTON FOR GARMENT

BACKGROUND OF THE INVENTION

1. Field of the Invention

The present invention relates to a button for attachment to a garment fabric, and more particularly to a button including a tack member having a shank provided with an end portion which is plastically deformable under the influence of a force applied thereto to fit into a button body of the button.

2. Description of the Prior Art

It is known that a metallic button, e.g. a button for blue jeans, is fastened to a garment fabric by a tack member adapted to be joined with a button body of the button. This tack member generally comprises a head and a shank including a deformable tapered end portion. When the tack member is joined with the button body, the shank passes through the garment fabric and then undergoes deformation to some extent upon engagement with the inner wall of the button body.

In one known tack member of this type, the shank has a pointed end portion which is adapted to be bent over in any direction. The major drawback with this prior device is that the bending of the end portion causes an undesired irregular deformation or bend in other portions of the shank and also of the button body, with the result that the button is attached improperly to the fabric in an inclined position.

Another known tack member, disclosed by Japanese Utility Model Publication (Kokoku) No. 44-5791, includes a shank having near its tapered end a transversely extending recess or groove which enables the same to bend easily in one direction about the recess upon engagement of the tack member with the button body. This prior device, however, has a drawback in that the shank has reduced mechanical strength due to removal of the material thereof to form the recess. With this structural weakness of the shank, the tack member would tend to be easily deformed or bent back so as to enable it to be removed from the button body when a relatively great pulling force is exerted on the button. There is also another drawback with this tack member in that the garment fabric positioned around the shank is circumferentially disproportionally dragged into the hollow hub by an irregularly bent portion of the shank other than the tapered end portion during the insertion of the shank to the hollow hub. Thus the garment fabric is apt to pucker so that yarns of the fabric are partially brought into the hollow hub in an irregular manner at different sides of the shank.

SUMMARY OF THE INVENTION

According to the present invention, a button comprises a capped button body and a tack member adapted to join with the button body for sandwiching a garment fabric therebetween to thereby attach the button to a garment. The button body includes a hollow hub with a flanged free end. The tack member includes a head and a shank having a cylindrical stem, an end portion contiguous thereto and a circumferentially recessed portion disposed therebetween, the recessed portion having a stiffness greater than the other portion of the shank. When the shank is forced through the hollow hub, the end portion is plastically deformable about said recessed portion into an axially compressed and radially uniform configuration so that the deformed end portion tightly engages the flanged free end for thereby attaching the button to the garment fabric.

It is therefore an object of the present invention to provide a button having a tack member which will overcome the foregoing difficulties of the prior art and which incorporates structural features to enable a neat and firm attachment of the button to a garment fabric.

A more specific object of the invention is to provide a button including a tack member having a shank which enables a stable and properly positioned attachment of a button body of the button to a garment fabric by allowing only an end portion of the shank to plastically deform into a certain configuration for thereby keeping the garment fabric free from puckering even when yarns of the latter are dragged into the button body by the shank being intruded therein.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF PREFERRED EMBODIMENTS

Figure 1:
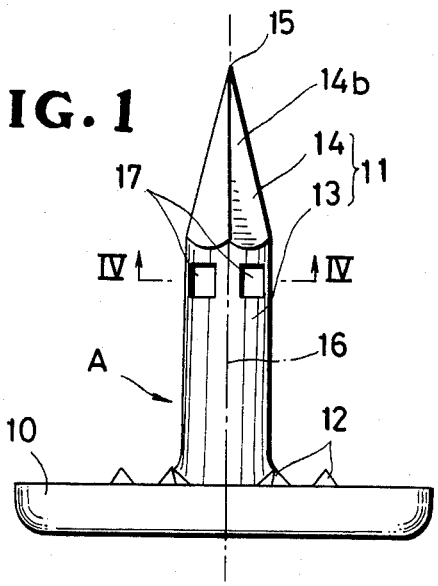
FIG. 1 is an elevational view of a tack member embodying the present invention.
Figure 2:
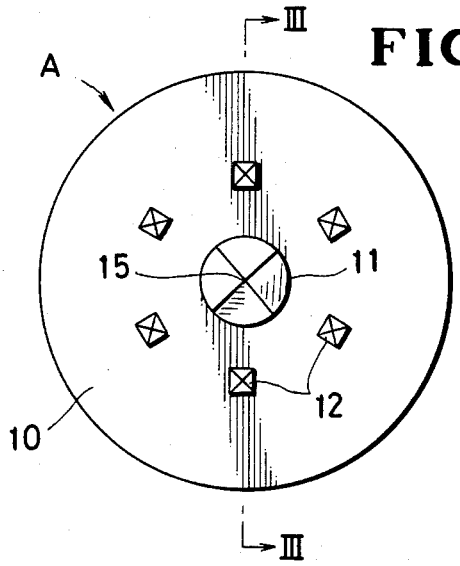
FIG. 2 is a plan view of the tack member of FIG. 1.

As shown in FIGS. 1 to 6, a button comprises a button body B and a tack member A made of metal, such as aluminum, brass, or iron, and including a head 10 of disk shape and a shank 11 projecting perpendicularly centrally from one face of the head 10.

The head 10 has on said one face a plurality of small projections 12 for thereby biting into a garment fabric C when the face is pressed against the garment fabric during attachment of the button to the fabric. The shank preferably comprises mainly three portions, a stem 13 of circular cross-section contiguous to the head 10, an end portion 14 formed into a pyramidal configuration, and a recessed portion 20 disposed circumferentially in the stem 13 adjacent to the end portion 14, the apex 15 being coaxially aligned with the stem 13.

In this embodiment, the recessed portion 20 includes four recesses 17, and bulged portions or protruberances 18 each defining respective edges of the recesses 17. The recesses 17 are circumferentially spaced from each other at almost equal angular intervals and register in position with respective side faces which jointly define the pyramid of the end portion 14.

The number of recesses is not limited to four and thus the recessed portion may have a plurality of recesses, or otherwise an annular groove as described below.

Figure 4:
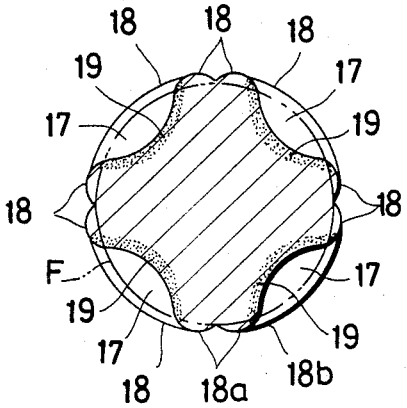
FIG. 4 is a horizontal cross-sectional view taken along line IV—IV of FIG. 1.

For manufacturing the recesses 17, the shank is punched all at once with four forming dies of almost prismoidal shape each having rounded corners at its punching end. With this punching process, each recess 17 is formed into an arcuate cross-sectional configuration, as shown in FIG. 4. As a result, a portion of the shank indicated in phantom line F is deformed plastically into a configuration indicated in solid line in FIG. 4, wherein a mass of material of the shank 11 is displaced due to the plasticity thereof into the peripheral bulged portions 18.

The peripheral bulged portions 18 and a bottom portion 19 of the recess 17 are stiffened through work hardening by punching for thereby being restrained in their ductility.

Figure 5:
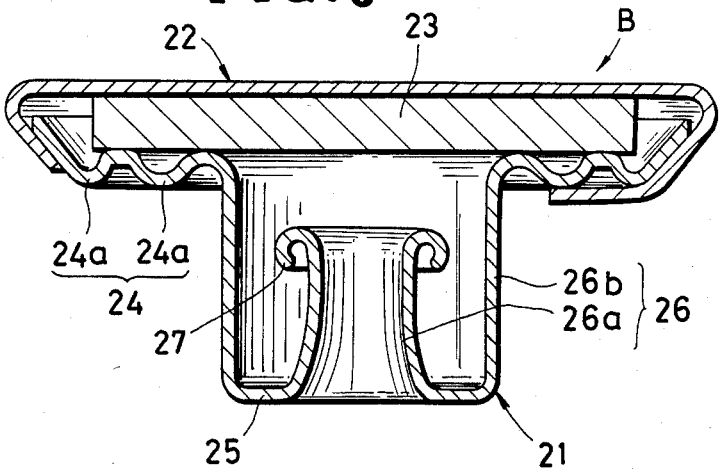
FIG. 5 is a vertical cross-sectional view of a button body.

As shown in FIG. 5, the button body B adapted to be intruded by the tack member A comprises a button back 21 having a hollow hub 26, a cap 22 covering the button back on its one obverse side, and a circular back plate 23 sandwiched between the button back 21 and the cap 22. The button back 21 includes a flanged head 24 composed of annular undulated concentric fringe portions 24*a* extending radially outwardly for being covered by the cap 22. The hollow hub 26 has inner and outer walls 26*a*, 26*b* merged with each other at a lowermost portion 25 flange or flanged free end 27 defined by an annular curled edge. The flange 27 is adapted to engage the end portion 14 of the shank 11 when the same is plastically deformed (as described hereafter).

Figure 6:
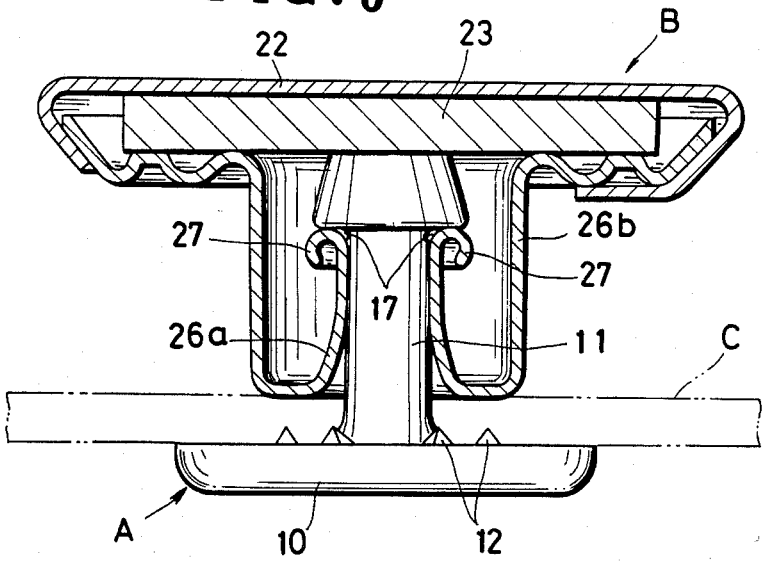
FIG. 6 is a vertical cross-sectional view of a button according to the present invention, showing the same having been attached to a garment fabric.

In use of the tack member A, as shown in FIG. 6, the shank 11 is forced through the garment fabric C into the hollow hub 26 of the button body B for thereby compressing the pyramidal end portion 14 against the back plate 23. At this time, the end portion 14 is deformed plastically to swell radially uniformly while engaging peripherally with the flanged free end 27 for attaching the button to the garment fabric C. This is deformation partly because the compressing forces or pressures concentrate on the apex of the end portion and then work in a parallel direction with the axis 16 of the shank 11, and partly because the circumferentially stiffened and less ductile recessed portion 20 resists being deformed and hinders the end portion 14 from deforming to bend over in only one direction. If the shank were to have virtually uniform ductility all through the length, the linear pressing forces or stress would act all through the length of the shank 11 to thereby deform the stem portion 13 in an inclined relation with respect to the head 10. However, in this embodiment, the stress is hindered from acting onto the stem portion 13 lower than the recessed portion 20. Thus the stem portion 13 is kept free from any deformation for thereby enabling the button to attach onto the fabric C in a proper position.

With this arrangement, the tack member A has an improved structure of the shank 11 which ensures and maintains a tight and sound engagement of the same with the button body B even when relatively great pulling forces are applied to the button. This relationship is also true when the shank 11 is made of a relatively soft metal such as aluminum or brass. The tack member A thus keeps the garment fabric C free from puckering in response to attachment of the button thereto.

As described in the "Prior Art" section, in attachment of the button to a garment fabric, puckering occurs in the fabric when the fabric (or yarns thereof) is brought into a hollow hub of the button body by a shank pierced through the fabric. However, the tack member's shank 11 according to the invention, provides peripherally bulged portions 18, which coact with the inner wall of the hollow hub 26 to shear yarns of the fabric C while moving along the wall. This function is true even when the fabric C is relatively thin.

Figure 7:
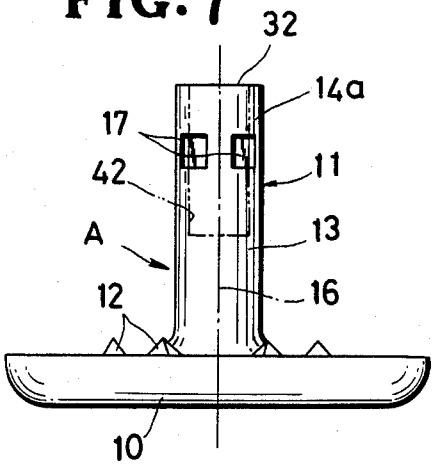
FIGS. 7 through 12 are elevational views showing respectively modified tack members according to the invention.
Figure 8:
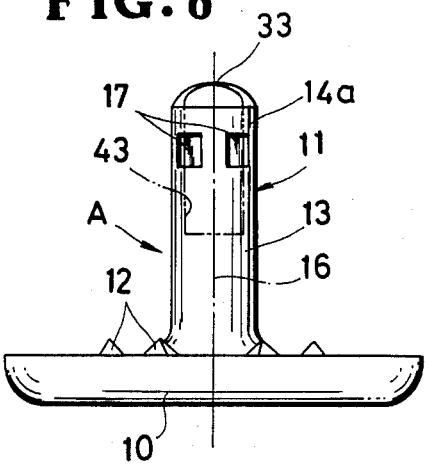
Figure 9:
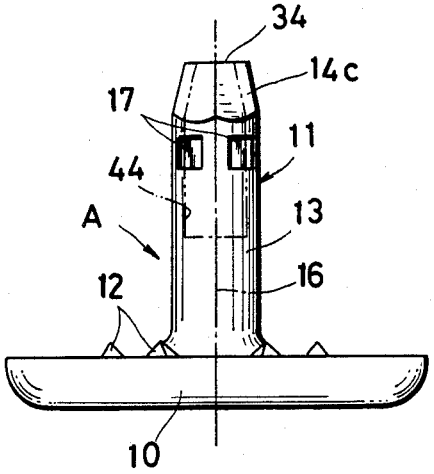
Figure 10:
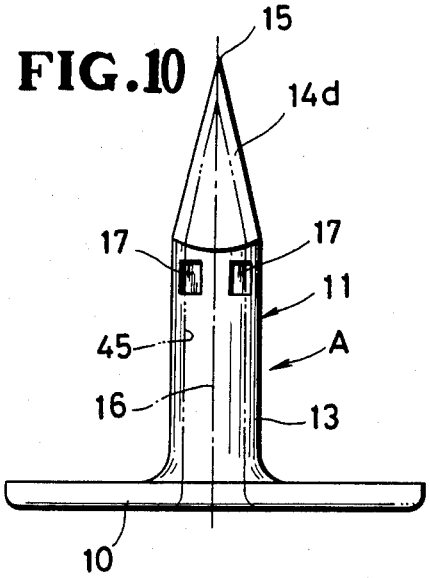

In other embodiments, an end portion of the shank 11 may have a flat or convex surface, or in a truncated pyramidal configuration as shown in FIGS. 7 through 9, or further in a conical configuration as shown in FIG. 10. All these of the invention have virtually the same function as the embodiment of FIG. 1.

Figure 3:
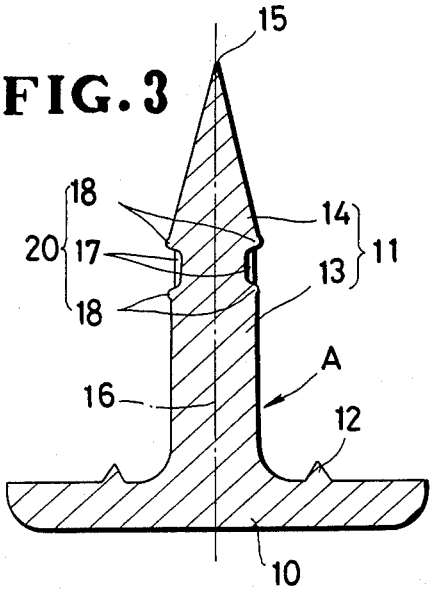
FIG. 3 is a vertical cross-sectional view taken along line III—III of FIG. 2.

A tack member A shown in FIG. 7 is similar to the tack member A shown in FIGS. 1 and 3, but here the shank 11 has a straight or non-tapered end portion 14*a* having a flat top end surface 32 perpendicular to the axis 16 and remote from the head 10.

A tack member A in FIG. 8 is similar with the tack member A in FIG. 7 but the shank 11 shown in FIG. 8 has a convex top end surface including an apex aligned with the axis 16 of the shank 11.

FIG. 9 shows another tack member A according to the invention including a shank 13 having a truncated pyramidal end portion 34. This embodiment is also similar to the tack member A in FIG. 1.

FIG. 10 shows another tack member A according to the invention similar with the tack member A in FIG. 1, but the shank 11 of FIG. 10 has a conical end portion 14*d* including its apex 15 aligned with the axis 16 of the shank 13.

Figure 11:
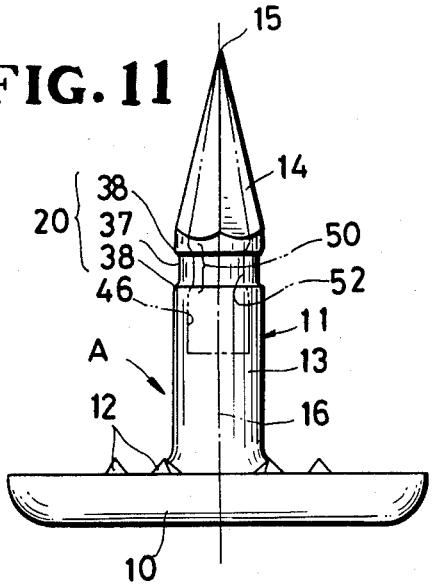

FIG. 11 shows a tack member A similar to the tack member A in FIG. 1, but the recessed portion 20 includes an annular groove 37 extending through the entire circumference of the stem 13 adjacent to the end portion 14 and a pair of lateral protuberances 38, 38 extending along the opposite side edges of the annular groove 37. When the stem 13 is punched radially inwardly with a suitable punching means, the annular groove 37 and the lateral proturberances 38 are formed all at once and deliberately have a stiffness greater than the other portion of the shank 11 as the four recesses 17 and the peripheral proturbelances 18 do.

Figure 12:
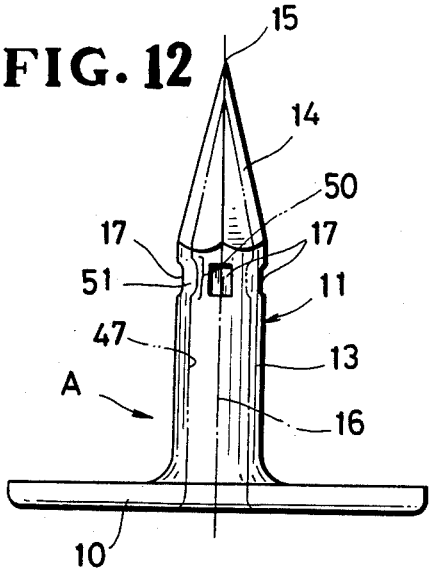

As shown in FIG. 12, a tack member A, including the shank 11 with an end portion of a pyramidal or quasi-pyramidal configuration such as tack members A respectively shown in FIGS. 1 and 9, may have the recesses 17 registered in position with respective side ridges of the pyramid or of the quasi-pyramid.

Structure of the shank 11 may be further modified as follows:

As indicated in phantom lines 42, 44 in FIG. 7 and FIG. 9, the respective shanks 11 may have a coaxial blind hole or a hollow portion extending in and between the end portion 14*a*, 14*c* and the stem 13. The blind holes 42, 44 have an open end in the end portion 14.

For another modification, the shank 11 may have a hollow portion extending longitudinally through the recessed portion 20 as indicated in phantom line 43, 46 respectively in FIGS. 8 and 11.

For still another modification, the entire shank 11 may be formed by a cold drawing process into a hollow structure having a hollow portion opened through the head 10 as indicated in phantom lines 45, 47 in FIGS. 10 and 12.

In these embodiments each having a hollow portion 42-47, the hollowed stem has the recessed portion 20 similar to the foregoing other embodiments of the present invention, with the result that a ribbed portion 50 (FIGS. 11 and 12) is formed in the inner wall defining said hollow portion of the stem 13 corresponding in obverse-to-reverse relation with the recessed portion 20. When the recessed portion 20 includes an annular groove 37, the ribbed portion 50 provides an annular rib 52 (FIG. 11) projecting radially inwardly from said inner wall. Alternatively, the ribbed portion 50 provides a plurality of ribs 51 (FIG. 12) projecting from the inner wall of the stem 13 when the recessed portion 20 includes a plurality of the recesses 17. The annular rib 52 or the ribs 51 correspond in number and position with the annular groove 37 and the recesses 17, respectively. Thus the shank 11 allows for an easy plastic deformation of its hollowed end portion in the attachment of the button to the garment fabric C, and functions similarly to the recesses 17 or the groove 37 provided in the said shank 11 of solid structure in the above-described other embodiments.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button for attachment to a garment fabric, comprising:

(a) a capped button body including a hollow hub having a flanged free end;

(b) a tack member having a head and a shank projecting perpendicularly and centrally from said head for being forced through the garment fabric into said hollow hub of said button body to thereby join said tack member with said button body, said shank including (1) a cylindrical stem contiguous to said head, (2) an end portion extending coaxially from said stem, and (3) a cold-pressed recessed portion disposed circumferentially in said stem adjacent to said end portion and having a stiffness greater than the other portion of said shank, said recessed portion being disposed in such a position that the same is disposed adjacent to said flanged free end of said hollow hub when said shank is fully inserted through said hollow hub with the garment fabric sandwiched between said hollow hub and said head of said tack member, said end portion being plastically deformable about said recessed portion into an axially compressed and radially uniformly swelled configuration when said shank is forced into said button body.

2. A button according to claim 1, said end portion having a cylindrical shape having a diameter the same as the diameter of said cylindrical stem.

3. A button according to claim 2, said cylindrical end portion having a flat end surface extending perpendicularly to the axis of said shank.

4. A button according to claim 2, said cylindrical end portion having a convex end surface.

5. A button according to claim 1, said end portion being tapered off in a direction away from said head.

6. A button according to claim 5, said tapered end portion having a pointed end aligned with the axis of said shank.

7. A button according to claim 6, said tapered end portion having a pyramidal shape.

8. A button according to claim 6, said tapered end portion having a conical shape.

9. A button according to claim 5, said tapered end portion having a flat end surface extending perpendicularly to the axis of said shank.

10. A button according to claim 9, said tapered end portion having a truncated pyramidal shape.

11. A button according to claim 1, said cold-pressed recessed portion including an annular groove extending through the full circumference of said cylindrical stem.

12. A button according to claim 11, said cold-pressed recessed portion having a pair of stiffened protuberances extending along the opposite sides of said annular groove.

13. A button according to claim 1, said cold-pressed recessed portion including a plurality of recesses circumferentially spaced at substantially equal intervals.

14. A button according to claim 13, said cold-pressed recessed portion having a plurality of stiffened protuberances each extending along the periphery of a corresponding one of said recesses.

15. A button according to claim 13, said end portion having a pyramidal shape with its apex aligned with the axis of said shank, said recesses being aligned with respective faces of said pyramidal end portion.

16. A button according to claim 13, said end portion having a pyramidal shape with its apex aligned with the axis of said shank, said recesses being aligned with respective side ridges of said pyramidal end portion.

17. A button according to claim 13, said end portion having a truncated pyramidal shape having a flat end surface extending perpendicularly to the axis of said shank, said recesses being aligned with respective side faces of said truncated pyramidal end portion.

18. A button according to claim 1, said shank having a hollow portion extending axially in and between said end portion and said cylindrical stem, said hollow portion including a ribbed portion projecting radially from an inner wall defining said hollow portion, said ribbed portion corresponding in position to said cold-pressed recessed portion.

19. A button according to claim 18, said cold-pressed recessed portion including an annular groove extending through the full circumference of said cylindrical stem, said ribbed portion including an annular rib extending through the full circumference of said inner wall and being complemental in contour with said annular groove.

20. A button according to claim 18, said cold-pressed recessed portion including a plurality of recesses circumferentially spaced at substantially equal intervals, said ribbed portion including a plurality of ribs corresponding in position to and complemental in contour with said recesses, respectively.

21. A button according to claim 18, said hollow portion including an axial blind hole having an open end disposed at a distal end of said shank.

22. A button according to claim 18, said hollow portion including an axial blind hole having an open end disposed in said head.

23. A button according to claim 22, said shank having said blind hole being cold-drawn.

24. A button according to claim 18, said hollow portion defining a fully closed axial hollow interior space.

* * * * *